United States Patent [19]

Lepera

[11] Patent Number: 4,598,911

[45] Date of Patent: Jul. 8, 1986

[54] GOLF SWING INSTRUCTIONAL AID

[76] Inventor: Pasquale Lepera, 83 Chestnut St., Ramsey, N.J. 07446

[21] Appl. No.: 631,392

[22] Filed: Jul. 16, 1984

[51] Int. Cl.[4] ..... A63B 69/36

[52] U.S. Cl. ..... 273/186 A; 273/186 C; 434/252

[58] Field of Search ..... 273/186 A, 194 R, 186 C, 273/29 A, 26 B

[56] References Cited

U.S. PATENT DOCUMENTS

| | | | |
|---|---|---|---|
| 1,644,392 | 10/1927 | Myers | 273/191 |
| 2,482,015 | 9/1949 | McConnell | 273/194 R |
| 3,197,209 | 7/1965 | Arena | 273/183 B |
| 3,360,269 | 12/1967 | Molinari | 273/186 A |
| 3,434,722 | 3/1969 | Esposito | 273/186 A |
| 3,758,117 | 9/1973 | Harrison | 273/186 A |
| 3,897,068 | 7/1975 | Staples | 273/186 A |
| 4,085,936 | 4/1978 | Patterson | 273/194 R X |
| 4,133,535 | 1/1979 | Romar | 273/192 |

*Primary Examiner*—George J. Marlo

*Attorney, Agent, or Firm*—W. Patrick Quast

[57] ABSTRACT

A golf swing instructional aid is provided having a simulated golf ball mounted on one section of a two-sectioned support rod. The other rod section has a clamp for clamping the aid to a golf club shaft. The rod sections are disposed at an angle such that the simulated golf ball is disposed in a square impact position with respect to the club face, so that a user of the club during practice swings can see the correct position of the club face with respect to a golf ball at the moment of impact, visualize the flight path of the ball and thereby practice correct positioning of the user's hands and body with respect to the club and ball. Separate clamp arrangements are provided for golf woods and irons.

14 Claims, 8 Drawing Figures

FIG. 1
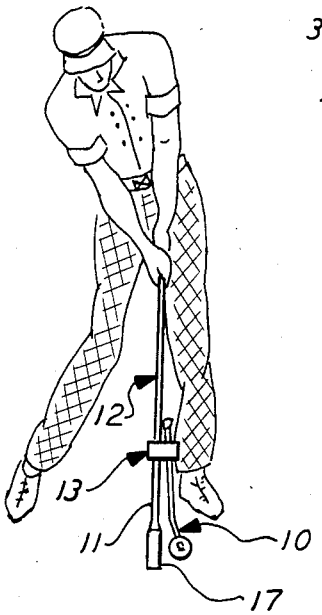
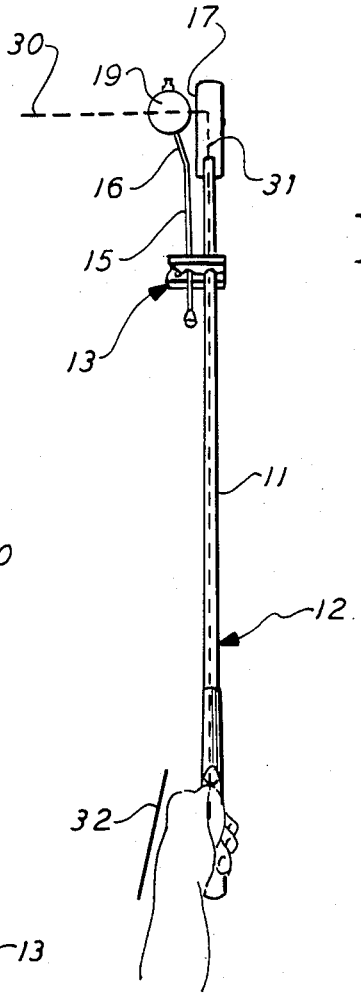
FIG. 4
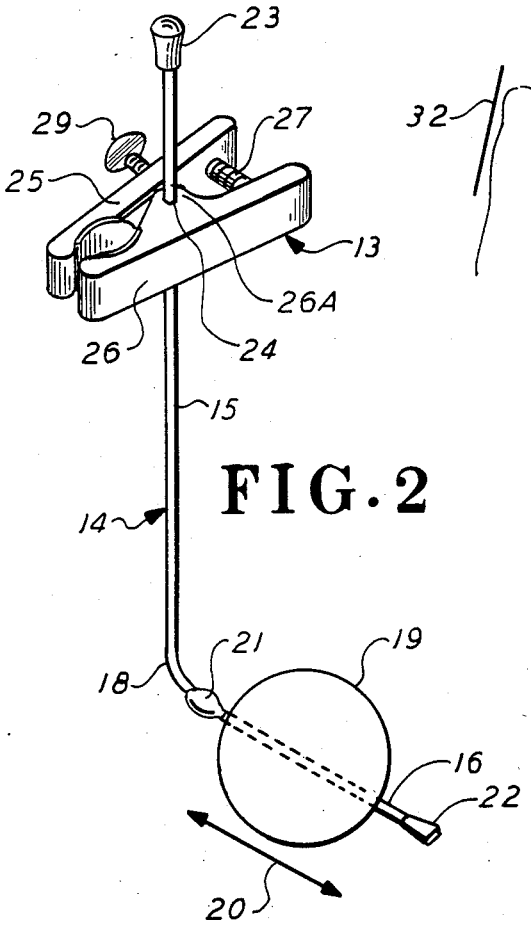
FIG. 2
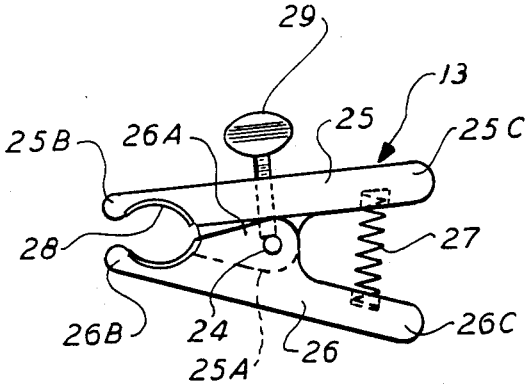
FIG. 3

GOLF SWING INSTRUCTIONAL AID

BACKGROUND OF THE INVENTION

1. Field of the Invention

This invention relates to sports equipment and more particularly to a golf swing instructional aid which may be employed with golf clubs during practice swings to enable the user of the club to learn the correct positioning of his hands and body during such swings.

2. Description of the Prior Art

The sport of golf is big business throughout the world today. Substantial sums of money have been expended for golf lessons, golf books and other literature and golf swing instructional aids which are intended to enable a golfer to perfect his swing. The golf swing instructional aids which have been developed are many and varied. They include complex equipment in the nature of machines to which a golf club is attached and which mechanically and physically limit movement of the club to what is considered to be a good swing for a particular stroke. Other devices include free standing guides which permit the golfer to visually align his club with a portion of the guide and thereby learn the mechanics of a particular stroke. Finally, still other devices take the form of directional arrows and the like which are attached to a golf club and which are intended to show the user of the club the direction of the flight path of the ball after it is hit.

With the advent of the Square-To-Square Method of golf swing which is practiced by many golf professionals today, a need has arisen for a golf swing instructional aid which may be used to teach this method. In the Square-To-Square Method, great emphasis is placed upon the position of the ball with respect to the club face at the moment of impact and upon the positioning of the hands and body of the golfer during the various stages of the swing. A golf swing instructional aid for teaching this method should be usable on the club during all of the various stages of the swing. It should be light in weight and present minimum wind resistance so that the feel of the club in the golfer's hands with the aid in place closely approximates the feel of a club without the aid. The instructional aid should also be capable of being easily and quickly installed on a club and removed from the club. It is also desirable that the instructional aid may be used with both golf woods and golf irons. Finally, the instructional device should be mechanically rugged in construction to permit the hard usage which often accompanies practice golf sessions.

SUMMARY OF THE INVENTION

It is an object of this invention to provide a golf swing instructional aid which is especially suited for the teaching of the Square-To-Square Method of golf swing but which also may be used to teach other methods.

It is a further object of this invention to provide a golf swing instructional aid which is light in weight and presents minimum wind resistance during use, so that the feel of the golf club with the aid installed closely approximates the feel of the club without the aid.

It is a still further object of this invention to provide a golf swing instructional aid which may be easily and quickly installed on and removed from golf clubs.

It is another object of this invention to provide a golf swing instructional aid which is mechanically rugged in construction and which may be used on both golf woods and golf irons.

Briefly, the golf swing instructional aid of the invention comprises an elongated support member having a simulated golf ball mounted on the member adjacent one end thereof for support thereby and mounting means on the support member adapted to mount the member on the shaft of a golf club with the simulated golf ball adjacent the club face in a square impact position, so that a user of the club can see the correct position of the club face with respect to a golf ball at the moment of impact, visualize the flight path of the ball and thereby practice the correct positioning of the user's hands and body with respect to the club and ball during practice golf swings. The support member has a first section which is adapted to extend along the club shaft and a second section disposed at an angle with respect to the first section. The angle is such that the second section is adapted to extend along the club face. The mounting means, which may be a releasable clamp, is pivotally disposed on the first support member section to permit angular adjustment of the second support member section and the simulated ball with respect to the club face. The simulated golf ball is slidably disposed on the second support member section to permit lateral adjustment of the simulated ball with respect to the center of the club face. Locking means are provided on the mounting means to lock the first support member section in place with respect to the mounting means, so that once the position of the instructional aid is set for a particular golf club, the instructional aid may be easily and quickly removed and installed without disturbing the position of the parts thereof. Different clamping means may be employed, if desired, for use with golf woods and golf irons.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 1 is a perspective view of a golfer using a golf club with the golf swing instructional aid of the invention attached thereto;

FIG. 2 is a perspective view on an enlarged scale of the golf swing instructional aid of FIG. 1;

FIG. 3 is a top plan view of the clamping means of the golf swing instructional aid shown in FIGS. 1 and 2;

FIG. 4 is a top view showing the golf swing instructional aid of the invention in use on a golf iron, such as a putter, for example;

DESCRIPTION OF THE PREFERRED EMBODIMENT OF THE INVENTION

Figure 5:
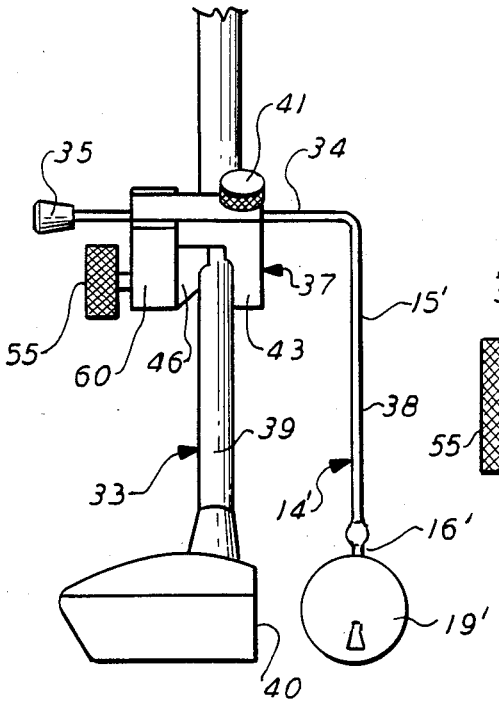
FIG. 5 is a perspective view of a golf swing instructional aid constituting an alternative embodiment of the invention which is particularly suited for golf woods, such as a driver, for example.

Referring now to FIG. 1 of the drawings, there is shown a golf swing instructional aid, indicated generally as 10, which has been constructed in accordance with the teachings of the present invention and which is installed on the shaft 11 of a golf club, indicated generally as 12. The instructional aid 10 is provided with a releasable clamp, indicated generally as 13, which is adapted to mount the aid on the shaft 11 of the club. As seen in FIG. 2, the instructional aid has an elongated support member, indicated generally as 14, which has a first section 15 which is adapted to extend along the club shaft 11 and a second section 16 which is disposed at an angle with respect to the first section. The angle between the first and second sections is such that the second support member section 16 is adapted to extend along the face 17 of the golf club. In practice, the support member 14 may conveniently comprise a single length of rod or wire which has been bent at 18 to form the two rod sections. The rod may be of circular or square cross-section and is preferably fabricated of a light-weight material, such as aluminum or a suitable plastic, for example.

A simulated golf ball 19 is slidably disposed on the second support member section 16 to permit lateral adjustment of the simulated ball with respect to the center of the club face 17 in the direction of the arrows 20. Crimps 21 are provided on opposite sides of the simulated golf ball 19 to limit the sliding movement of the ball and prevent it from sliding off the support rod 14. In the view of FIG. 2, the crimp at the free end of the second support member section 16 is covered by a protective plastic cap 22. A similar cap 23 is provided at the free end of the first support member section 15. The simulated golf ball 19 is preferably a replica of a real golf ball which is made of a plastic or another suitable light-weight material. Although a real golf ball could be used for the ball 19, the weight of a real golf ball would make the club too heavy during practice swings, so that the club would not have the "feel" of a golf club without the instructional aid attached thereto. The term "simulated golf ball" as used herein, however, shall be deemed to include both a real golf ball and an artificial golf ball.

As seen in FIGS. 2 and 3 of the drawings, the first support rod section 15 is slidably and rotatably disposed in a bore 24 which extends through the clamp 13. The clamp 13 comprises a pair of oppositely-disposed clamp members 25 and 26 having a fulcrum 25A and a fulcrum 26A formed between the ends thereof through which the bore 24 passes. Fulcrum 25A is disposed within fulcrum 26A in a telescoping relationship. Accordingly, each of the clamp members 25 and 26 is adapted to pivot about the bore 24 and the first support rod section 15 which passes therethrough. Fulcrum 25A of clamp member 25 serves to divide that clamp member into a jaw portion 25B which is adapted to engage the club shaft 11 and a lever portion 25C which is adapted to open and close the clamp. Similarly, clamp member 26 is divided by fulcrum 26A into a jaw portion 26B and a lever portion 26C.

A helical compression spring 27 is disposed between the lever portions of the clamp members in openings, not shown, in the lever portions for biasing the lever portions apart. When the lever portions 25C and 26C are biased apart by the spring 27, the jaw portions 25B and 26B are biased together to close the clamp. Each of the jaw portions 25B and 26B is provided with a lining 28 fabricated of rubber or a suitable plastic material which will adequately grip the club shaft 11 to prevent slippage of the instructional aid but which will not mar the finish of the club shaft. Locking means, which may conveniently comprise a set screw 29 which is adapted to engage the first support rod section 15, is provided on one of the clamp members 25, 26, as illustrated. The clamp 13 should also be fabricated of a light-weight material, such as aluminum or a suitable plastic, for example, so that the weight of the instructional aid is kept at a minimum.

As seen in FIG. 4, by virtue of the foregoing arrangement, the simulated ball 19 may be slidably moved along the second support rod section 16 to permit lateral adjustment of the simulated ball with respect to the center of the club face 17 and the first support rod section 15 may be both rotated and slidably moved in the bore 24 in the clamp 13 to permit angular adjustment of the second support rod section 16 and the simulated ball with respect to the club face. These three adjustments permit the simulated golf ball 19 to be placed adjacent the club face 17 in a square impact position. In a square impact position, the club face 17 forms a 90° or "square" angle with respect to the anticipated flight path of the ball after impact. The flight path is represented by the dotted line 30 in FIG. 4. Since the Square-To-Square Method of golf swing places great emphasis upon the use of a golf club with the ball in a square impact position, it is readily apparent that the golf swing instructional aid of the invention greatly facilitates the learning of this method.

The Square-To-Square Method also emphasizes correct placement of the golfer's hands and body with respect to both the golf club face and the ball. For example, as seen in FIG. 4, it is strongly recommended that the club be gripped by the left hand so that the thumb of that hand lies along the dotted line 31, which is essentially the longitudinal axis of the club shaft, and the golfer's arm be positioned so that a straight-line relationship between the back of the hand, wrist and lower forearm is established as represented by the solid line 32. The use of similated golf ball, which is a three-dimensional object, enables the golfer to not only visualize the anticipated flight path of the ball after impact but also to correctly position his hands with respect to the club shaft. The known, prior art instructional aids provide only a two-dimensional representation of the flight path of the ball with respect to the club head and provide no guidance as to the correct placement of hands and body. In a similar fashion, the instructional aid of the invention also enables the golfer to correctly position his hands, arms and body during the backswing, the top of the swing and the downswing in accordance with the principles of the Square-To-Square Method, since he at all times is able to see the position of the club face 17 with respect to the simulated ball 19.

Since the golf swing instructional aid of the invention is both light in weight and presents a minimum wind resistance, it may be placed on a golf club during practice swings and will not materially alter the "feel" of the club for the golfer. The user merely clamps the device to the shaft of the desired golf club by using the releasable clamp 13 and checks the positioning of his hands and body during the various phases of the swing. The instructional aid may then be easily removed by one hand without distrubing the golfer's grip on the club by his other hand. The golfer is then ready to address real golf balls and play golf.

Although the golf swing instructional aid of the invention is shown in FIGS. 1 through 4 of the drawings as being utilized with an iron, such as a putter, for example, it is readily apparent that it may be utilized with all types of golf clubs because of the range of adjustments provided in the device. An alternative embodiment of the invention is shown in FIGS. 5 through 8 of the drawings, however, wherein a modified instructional aid is shown as being utilized with a golf wood 33 rather than an iron. In describing this embodiment of the invention, reference numerals with a prime notation will be employed to designate elements of the device which are the same as or similar to the correspondingly numbered elements in the embodiment shown in FIGS. 1 through 4.

As seen in FIG. 5, the support rod or member 14' is again provided with two main sections 15' and 16' which are angularly disposed with respect to each other in the same manner as the support rod sections in the embodiment of FIGS. 1 through 4. The simulated ball 19' is again slidably disposed on the second support rod section 16'. The first support rod section 15', however, has a first portion 34 at the free end 35 thereof which passes through a bore 36 formed in a clamp, indicated generally as 37. The first support rod section 15' also has a second portion 38 which is substantially perpendicular to the first portion 34 and which is adapted to extend along the shaft 39 of the club. This arrangement permits the transverse spacing between the simulated ball 19' and the face 40 of the club to be adjusted by sliding the rod portion 34 in or out of the bore 36 in the clamp, so that the larger club head sometimes found on golf woods may be accomodated. Since the support rod portion 34 may also be rotated in the bore 36, the angular position of the second support member section 16' and the simulated ball 19' may also be adjusted with respect to the club face 40. Locking means, such as the set screw 41 illustrated, is provided to lock the support rod in position with respect to the clamp and hence the club.

Figure 6:
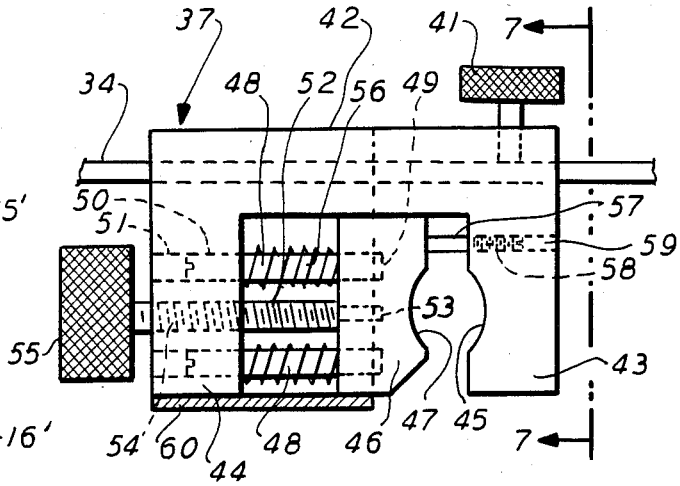
FIG. 6 is a top plan view of the clamping means in the embodiment of the invention shown in FIG. 5 with one side of a protective cover removed to reveal details of construction.
Figure 7:
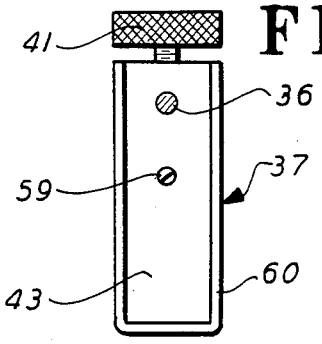
FIG. 7 is a side elevational view, partly in section, of the clamping means of the instructional aid shown in FIGS. 5 and 6 taken in the direction of the arrows 7—7 in FIG. 6.
Figure 8:
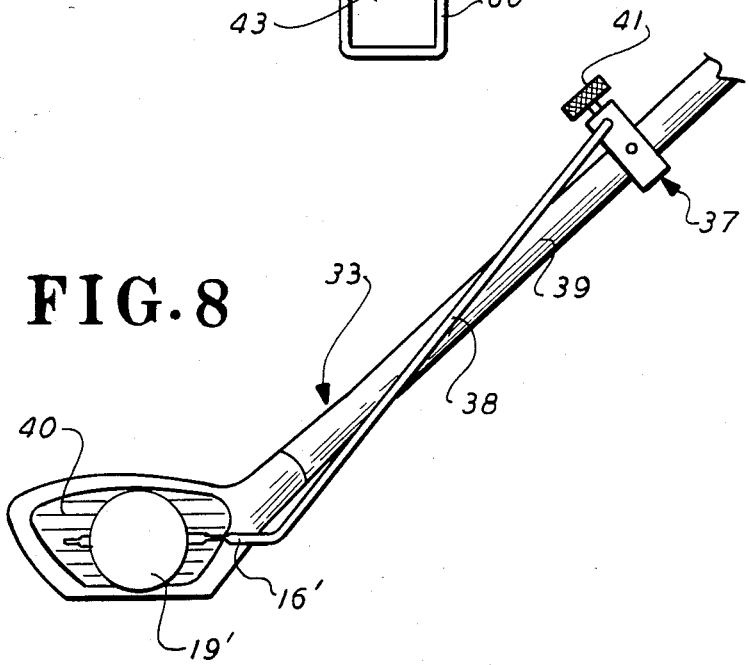
FIG. 8 is a side elevational view of the driver of FIG. 5 showing the golf instructional aid in place.

As seen in FIGS. 5, 6 and 7, the clamp provided in this embodiment of this invention has a substantially channel-shaped body having a web 42 which joins two flanges 43 and 44. One flange 43 is formed as a fixed jaw member and has a depression 45 formed therein which is adapted to engage the club shaft. The clamp also has a movable jaw member 46 having a similar depression 47 formed therein and is disposed between the flanges of the clamp body. Guide means are provided between the movable jaw member 46 and the other flange 44 of the clamp body to permit sliding movement of the movable jaw 46 towards and away from the fixed jaw 43 of the clamp. The guide means comprise two guide pins 48. Each pin has one end 49 thereof secured to the movable jaw member 46 by means such as threading for example. The other end 50 of each guide pin is slidably disposed in an opening or bore 51 which extends through the clamp body flange 44. The guide means also has a rotatable control shaft 52 which has one end 53 thereof rotatably disposed in the movable jaw member 46 and the other end 54 thereof threadedly engaging another opening or bore in the clamp body flange 44. A knob 55 is provided on the control shaft to permit the shaft to be easily rotated. Helical compression springs 56 are disposed concentrically about the guide pins 48 to bias the movable jaw member 46 towards the fixed jaw member 43. A stop rod or member 57 has one end 58 thereof threadedly engaging a bore 59 in the fixed jaw member 43, so that the length of the rod which protrudes into the space between the fixed and movable jaw members is adjustable to thereby prevent the jaws of the clamp from being fully closed. Finally, if desired, a substantially U-shaped removable cover 60, as shown in FIGS. 5 and 6 and 7 of the drawings, may be utilized to cover and protect the exposed pins and control shaft between the movable jaw member 46 and the clamp body flange 44.

The clamp arrangement utilized in this embodiment of the invention is particularly saftisfactory in that if readily accomodates the often larger-diameter club shafts found in golf woods. In use, when the clamp is fitted to a particular club, the stop rod 57 is rotated in threaded bore 59 until the spacing between the jaws of the clamp is slightly less than the diameter of the golf club shaft. Accordingly, when the clamp is opened to either remove the instructional aid from a club shaft or place it thereon, time is saved because the clamp need not be opened from a fully closed position. The movable jaw member 46 may be moved by finger pressure against the force of the compression springs 56 to open the jaws and place the clamp into engagement with the club shaft. If the compression spring force is insufficient to position the clamp securely on the club shaft, the control shaft 52 may be rotated by knob 55 to securely lock the clamp jaws in place.

It is believed apparent that many changes could be made in the construction and described uses of the foregoing golf swing instructional aid and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A golf swing instructional aid comprising:

an elongated support member;

golf ball simulation means having the appearance of a spherical golf ball mounted on said member adjacent one end thereof for support thereby; and mounting means on said support member adapted to mount said member on the shaft of a golf club, said elongated support member and said mounting means cooperatively adapted to position said golf ball simulation means in front of and immediately adjacent the club face of said golf club, on an imaginary line substantially perpendicular to the desired point of contact on the club face, so that a user of the club can see that the correct position of the club face with respect to a golf ball at the moment of impact, visualize the flight path of the ball and thereby practice the correct positioning of the user's hands and body with respect to the club and ball during practice golf swings.

2. A golf swing instructional aid as claimed in claim 1 wherein said support member has a first section adapted to extend along the club shaft, and a second section disposed at an angle with respect to said first section, said angle being such that said second section is adapted to extend in a plane generally parallel to the plane of the club face;

said mounting means is disposed on said first support member section; and said golf ball simulation means is disposed on said second support member section.

3. A golf swing instructional aid as claimed in claim 2 wherein said mounting means is pivotally disposed on said first support member section to permit angular adjustment of said second support member section and said golf ball simulation means with respect to the club face; and said golf ball simulation means is slidably disposed on said second support member section to permit lateral adjustment of said golf ball simulation means with respect to the center of the club face.

4. A golf swing instructional aid as claimed in claim 3 wherein said second support member section is rod-shaped and is provided with crimps on opposite sides of said golf ball simulation means to limit the sliding movement thereof.

5. A golf swing instructional aid as claimed in claim 3 wherein said mounting means is a releasable clamp having the jaws thereof adapted to engage the club shaft to facilitate placement of the aid on the club and removal therefrom.

6. A golf swing instructional aid as claimed in claim 5 wherein said first support member section is rod-shaped and is rotatably disposed in a bore in said clamp; and locking means are provided on said clamp to lock said first support member section in place in said bore and prevent rotation thereof.

7. A golf swing instructional aid as claimed in claim 6 wherein said clamp comprises a pair of oppositely-disposed clamp members, each of said clamp members having a fulcrum between the ends thereof about which the clamp member is adapted to pivot and which divides the clamp member into a jaw portion adapted to engage the club shaft and a lever portion adapted to open and close the clamp, and compression spring means disposed between the lever portions of said clamp members for biasing said lever portions apart and said jaw portions together; and said bore passes through the fulcrums of said clamp members, so that each clamp member is pivotally mounted for rotation about said first support member section to thereby permit said jaw portions to be opened by compression of said lever portions.

8. A golf swing instructional aid as claimed in claim 6 wherein said clamp comprises a substantially channel-shaped body with one of the flanges thereof being a fixed jaw member, a movable jaw member disposed between the flanges of said clamp body, guide means disposed between said movable jaw member and the other flange of said clamp body to permit sliding movement of said movable jaw member towards and away from said fixed jaw member, and compression spring means disposed between said movable jaw member and said other clamp body flange for biasing said movable jaw member towards said fixed jaw member, and said bore passes through said clamp body.

9. A golf swing instructional aid as claimed in claim 7 wherein said locking means is a set screw disposed in one of said clamp members and adapted to engage said first support member section.

10. A golf swing instructional aid as claimed in claim 8 wherein said guide means comprises at least one guide pin having one end thereof secured to said movable jaw member and the other end thereof slidably disposed in a first opening extending through said other clamp body flange, and a rotatable control shaft having one end thereof rotatably disposed in said movable jaw member and the other end thereof threadedly engaging a second opening extending through said other clamp body flange, so that rotation of said control shaft causes movement of said movable jaw member along said guide pin.

11. A golf swing instructional aid as claimed in claim 8 wherein said bore extends longitudinally through the web of said clamp body;

said first support member section has a first portion at the free end thereof which is slidably and rotatably seated in said bore and a second portion which is substantially perpendicular to said first portion and is adapted to extend along the club shaft, so that the transverse spacing between said second support member section and the club face may be adjusted; and said locking means is a set screw disposed in said clamp body web and adapted to engage said first portion of said first support member section.

12. A golf club comprising a shaft having a grip at one end thereof and a head at the other end thereof, said head having a club face thereon;

a support rod having a first section thereof extending along said shaft, and a second section thereof extending along said club face;

a simulated golf ball having the appearance of a spherical golf ball mounted on said second support rod section in a square impact position with respect to said club face; and mounting means on said shaft for mounting said support rod thereon for support thereby.

13. A golf club as claimed in claim 12 wherein said simulated golf ball is slidably mounted on said second support rod section to permit adjustment of the ball with respect to said club face.

14. A golf club as claimed in claim 12 wherein said first support rod section is slidably and rotatably disposed in a bore in said mounting means to permit adjustment of the ball with respect to said club face.

* * * * *